US005506899A

United States Patent [19]

Kimura

[11] Patent Number: 5,506,899

[45] Date of Patent: Apr. 9, 1996

[54] VOICE SUPPRESSOR

[75] Inventor: Koji Kimura, Kanagawa, Japan

[73] Assignee: Sony Corporation, Japan

[21] Appl. No.: 288,398

[22] Filed: Aug. 10, 1994

[30] Foreign Application Priority Data

Aug. 20, 1993 [JP] Japan ..... 5-205466

[51] Int. Cl.[6] ..... G10L 1/00

[52] U.S. Cl. ..... 379/387; 379/88; 379/80; 395/2.67; 395/2.71; 395/2.74

[58] Field of Search ..... 379/88, 387; 381/36, 381/51, 35, 31, 38, 104, 107, 108; 455/203, 239, 245, 250; 395/2.28, 2.29, 2.67, 2.72, 2.71

[56] References Cited

U.S. PATENT DOCUMENTS

| | | | |
|---|---|---|---|
| 4,403,348 | 9/1983 | Leland et al. | 455/203 |
| 4,513,177 | 4/1985 | Nishino et al. | 379/402 |
| 4,696,032 | 9/1987 | Levy | 379/390 |
| 5,138,661 | 8/1992 | Zinser et al. | 381/35 |
| 5,353,408 | 10/1994 | Kato et al. | 395/2.71 |
| 5,432,883 | 7/1995 | Yoshihara | 395/2.71 |

*Primary Examiner*—Jeffery Hofsass
*Assistant Examiner*—Jacques M. Saint-Surin
*Attorney, Agent, or Firm*—Limbach & Limbach; W. Patrick Bengtsson

[57] ABSTRACT

Synthesized voice having a high level is prevented from being output. A detector detects whether the level of a voice signal synthesized by a linear predictor based on linear predictive coefficients exceeds a predetermined threshold or not, and a control signal is output to a suppressor if the level exceeds the predetermined threshold. Upon receipt of the control signal from the detector, the suppressor stops the output of the voice signal supplied by the linear predictor.

6 Claims, 5 Drawing Sheets

VOICE SUPPRESSOR

BACKGROUND OF THE INVENTION

1. Field of the Invention

The present invention relates to voice suppressors for controlling the level of a synthesized voice signal and, more particularly, to a voice suppressor which is preferable for use in, for example, a receiver for receiving transmitted data and for decoding and synthesizing voice in a cellular telephone.

2. Detailed Description of the Related Art

In the field of mobile communication, efforts have recently been put forth for improving transmission efficiency by transmitting voice after encoding it at transmitters and by decoding the encoded data at receivers.

FIG. 4 shows a configuration of an example of a transmitter (encoder) of a cellular telephone used in such mobile communication. In such a transmitter, voice is encoded in accordance with linear predictive coding methods such as CELP (code excited linear predictive coding) method.

The CELP method is an encoding method wherein a signal obtained by performing linear prediction (short-range prediction) and pitch prediction (long-range prediction) on an input voice signal, i.e., a voice source signal, is subjected to vector quantization using a code book in which a variety of waveform patterns (code book vectors) are registered in advance.

According to the first CELP proposed by ATT in 1984, real time processing was difficult because an enormous amount of calculation was required. However, many proposals have been made recently on improvements for reducing the amount of calculation, and real time processing utilizing DSPs (digital signal processors) has been made practical according to some of those proposals.

In the transmitter shown in FIG. 4, code book indexes and a code book gain as initial values are supplied to a code book 31 and multiplier 32, respectively, and a pitch period and a pitch gain as initial values are supplied to a long-range predictor 35.

In the code book 31, waveform patterns of a variety of voice source signals are registered in advance in association with indexes, and a voice source signal associated with a code book index supplied by an error minimizer 41 is read to be supplied to the multiplier 32.

According to a code book gain supplied by the error minimizer 41, the multiplier 32 amplifies (or attenuates) the voice source signal from the code book 31 and supplies it to the long-range predictor 35. The long-range predictor 35 is comprised of an adder 33 and a log-range predictor memory 34 and generates a residual signal based on the voice source signal from the multiplier 32.

Specifically, in the long-range predictor 35, the voice source signal from the multiplier 32 is supplied through the adder 33 to the long-range predictor memory 34 which in turn delays the signal by a period of time corresponding to a pitch period supplied by the error minimizer 41. The long-range predictor memory 34 also amplifies (or attenuates) this delayed signal by a quantity corresponding to a pitch gain also supplied by the error minimizer 41 and outputs it to the adder 33.

The adder 33 adds the output of the long-range predictor memory 34 to the voice source signal from the multiplier 32 to generate the residual signal. This residual signal is input to a linear predictor 38 which in turn generates synthesized voice as described below. This synthesized voice is supplied to a subtracter 39. On the other hand, the input voice signal is subjected to analog-to-digital conversion at an analog-to-digital converter (not shown) and is supplied to the subtracter 39 and a linear predictive coefficient calculator 45. In the calculator 45, the voice signal is subjected to linear predictive analysis which is performed for each frame having a predetermined time length of, for example, 20 ms to calculate linear predictive coefficients of a predetermined number of degrees P, e.g., up to eighth degree.

The linear predictive coefficients are coefficients $\alpha_1$ through $\alpha_P$ which give the minimum result of the following equation where a voice signal at a point in time n is represented by $x_n$.

$$x_n+\alpha_1 x_{n-1}+\alpha_2 x_{n-2}+\ldots+\alpha_P x_{n-P}=\epsilon \qquad \text{Equation 1}$$

The linear predictive coefficients calculated by the calculator 45 are supplied to a short-range predictor 38 as a linear predictor and a parameter encoder 42.

The short-range predictor 38 is comprised of an adder 36 and a short-range predictor memory 37 and is supplied with the residual signal $\epsilon$ generated by the code book 31, multiplier 32 and long-range predictor 35 as well as the linear predictive coefficients of P-th degree $\alpha_1$ through $\alpha_P$ for each frame from the calculator 45.

The short-range predictor memory 37 incorporates registers which store the output $x_n$ of the adder 36 (which is synthesized voice to be described later) in a quantity corresponding to the number of the degrees of the linear predictive coefficients, i.e., stores P pieces of the output and sequentially latch the output $x_n$ of the adder 36.

Therefore, at the time n, signals from $x_{n-1}$ to $x_{n-P}$ obtained by delaying the output $x_n$ of the adder 36 by the quantities from 1 to P, respectively, are stored in the short-range predictor memory 37.

The short-range predictor memory 37 respectively multiplies the output $x_{n-1}$ through $x_{n-P}$ stored in the P pieces of registers incorporated therein by the linear predictive coefficients $\alpha_1$ through $\alpha_P$ from the adder 45, multiplies each of the results by −1, adds them and thereafter outputs the sum to the adder 36.

Thus, the adder 36 is supplied with a signal $-(\alpha_1 x_{n-1}+\alpha_2 x_{n-2}+\ldots+\alpha_P x_{n-P})$.

The adder 36 adds the residual signal $\epsilon$ from the long-range predictor 35 and the signal $-(\alpha_1 x_{n-1}+\alpha_2 x_{n-2}+\ldots+\alpha_P x_{n-P})$ from the short-range predictor memory 37 and outputs the sum. Therefore, the adder 36 outputs $\epsilon-(\alpha_1 x_{n-1}+\alpha_2 x_{n-2}+\ldots+\alpha_P x_{n-P})$ which is the voice signal $x_n$ at the time n as apparent from Equation 1.

The voice signal $x_n$ output by the adder 36 is supplied not only to the short-range predictor memory 37 but also to the subtracter 39. The subtracter 39 obtains the difference between the voice signal input at the time n and the voice signal from the adder 36 and supplies it to an auditory weighting device 40. The auditory weighting device 40 reduces quantization noises included in the difference supplied from the subtracter 40 utilizing a masking effect and outputs the result to an error minimizer 41.

The voice signal supplied from the adder 36 to the subtracter 39 has been calculated from the residual signal generated based on the code book index, code book gain, pitch period and pitch gain as initial values as described above. Therefore, in most cases, the voice signal is different from the input voice signal.

The error minimizer 41 performs code book search for determining the code book index and code book gain and pitch search for determining the pitch period and pitch gain so that the difference between the input voice signal supplied from the subtracter 39 through the auditory weighting device 40 and the voice signal supplied from the adder 36 (hereinafter referred to as error signal) is minimized.

The error minimizer 41 performs the code book search and pitch search on each of subframes which are parts of a frame divided at predetermined time intervals, e.g., 5 ms.

Practically, it is difficult to simultaneously obtain an optimum code book index, code book gain, pitch period and pitch gain by performing code book search and pitch search simultaneously because an enormous amount of calculation is required. Thus, the error minimizer 41 first performs the pitch search and then the code book search as described later.

Specifically, during the pitch search, the pitch period M and the pitch gain β are determined so that they give the minimum result of the following equation for each subframe if the pitch period and pitch gain are represented by M and β, respectively.

$$E_M=\Sigma((x(n)-\beta\times v(n-M)*h(n))*w(n))^2 \qquad \text{Equation 2}$$

where Σ represents summation with n=0 through N−1 (N is the length of the subframe) and * represents convolution integral; v(n), h(n) and w(n) respectively represent a voice source signal, an impulse response of the short-range predictor 38 and an impulse response of the auditory weighting device 40; and x(n) represents an input voice signal.

The pitch period M which brings the minimum result of Equation 2 can be given by obtaining M which brings the minimum result of the following equation.

$$E_M=\Sigma(x_w(n))^2-(\Sigma x_w(n)s_w(n))^2/\Sigma(s_w(n))^2 \qquad \text{Equation 3}$$

where $x_w(n)=x(n)*w(n)$; and $s_w(n)=v(n-M)*h(n)*w(n)$.

Since the first term on the right side of Equation 3 is constant within a subframe, the minimum value of Equation 3 can be given by selecting the value of M which maximizes the second term on the right side thereof.

After the pitch period M is determined as described above, the pitch gain β is calculated according to the following equation.

$$\beta=\Sigma x_w(n)s_w(n)/\Sigma(s_w(n))^2 \qquad \text{Equation 4}$$

Referring to the code book search, the code book index is represented by j (j=1, 2, . . . , J (J is the number of patterns of the voice source signals registered in the code book 31)); the voice source signal of the index j is represented by $c_j(n)$; and the optimum code book gain for the voice source signal $c_j(n)$ is represented by $\gamma_j$. Then, the voice source signal $c_j(n)$ which minimizes an error power $E_j'$ from the input voice signal as given by the following equation is selected as the optimum voice source signal.

$$E_j'=\Sigma((p(n)-\gamma_j\times c_j(n))*h(n))*w(n)^2 \qquad \text{Equation 5}$$

where p(n) represents the difference between the input voice signal x(n) and the synthesized voice signal $x_n$ generated by the short-range predictor 38 in accordance with the voice source signal $c_j(n)$.

The voice source signal $c_j(n)$ which minimizes the Equation 5 can be obtained by obtaining $c_j(n)$ which minimizes the following Equation 6.

$$E_j'=\Sigma(p_w(n))^2-(\Sigma p_w(n)q_{wj}(n))^2/\Sigma(q_{wj}(n))^2 \qquad \text{Equation 6}$$

where $p_w(n)=p(n)*w(n)$; and $q_{wj}(n)=c_j(n)*h(n)*w(n)$.

Since the first term on the right side of Equation 6 is constant within a subframe as in Equation 3, the minimum value of Equation 3 will be given by selecting the value of $c_j(n)$ which maximizes the second term on the right side thereof.

After the index j for the voice source signal $c_j(n)$ is determined as described above, the code book gain $\gamma_j$ is calculated according to the following equation.

$$\gamma_j=\Sigma p_w(n)q_{wj}(n)/\Sigma(q_{wj}(n))^2 \qquad \text{Equation 7}$$

Once the code book index j, code book gain $\gamma_j$, pitch period M and pitch gain β which minimize (the energy of) an error signal supplied to the error minimizer 41 are determined in accordance with the AbS (analysis by synthesis) method as described above, such parameters are supplied to a parameter encoder 42 along with the linear predictive coefficients calculated by the calculator 45.

In order to reduce the number of codes to be generated, the parameter encoder 42 obtains the differences between the parameters (the code book index j, code book gain $\gamma_j$, pitch period M and pitch gain β and linear predictive coefficients) of the current frame (or subframe) and the parameters of the preceding frame (or subframe) and interleaves the parameter difference data list so that absence of consecutive data will not be caused by an burst error or the like.

These parameters are supplied from the parameter encoder 42 to a channel encoder 43 which adds error detecting and correcting codes thereto. The parameters are then, for example, convolution-encoded frame by frame and are supplied to a modulator 44. The modulator 44 modulates the encoded data from the encoder 43 and transmits them as a spread spectrum signal having a frequency band spread by the use of, for example, PN (pseudo-random) codes.

FIG. 5 is a block diagram showing a configuration of an example of a receiver of a cellular telephone for receiving and decoding a voice signal which has been encoded and transmitted by the transmitter as described above. The signal (spread spectrum signal) received over a communication channel is supplied to a demodulator 1 to be demodulated using the same PN codes as the PN codes used at the modulator 44 of the receiver in FIG. 4. This demodulated signal is supplied to a channel demodulator 2 wherein it is subjected to convolution-decoding and error detection and correction utilizing the error detecting and correcting codes added thereto. The signal is then supplied to a parameter decoder 3.

The parameter decoder 3 decodes the parameters by deinterleaving the output of the decoder 2 to return the difference data list of the parameters (the code book index j, code book gain $\gamma_j$, pitch period M and pitch gain β and linear predictive coefficients) to the original state and by adding them with the parameters of the frame (or subframe) which has been decoded immediately before them.

The decoded parameters, i.e., the code book index j, code book gain $\gamma_j$, pitch period M and pitch gain β are respectively supplied to a code book 4, a multiplier 5 and a long-range predictor 8, and the linear predictive coefficients is supplied to a linear predictor 11.

In the code book 4, waveform patterns of voice source signals which are completely identical to those in the code book 31 of the transmitter 4 in FIG. 4 are registered in association with indexes, and the code book 4 outputs the voice source signal associated with the code book index supplied from the parameter decoder 3 to the multiplier 5.

The multiplier 5 amplifies (or attenuates) the voice source signal from the code book 4 in a quantity corresponding to the code book gain supplied by the parameter decoder 3 and outputs the result to the long-range predictor 8.

The long-range predictor 8 is comprised of an adder 6 and a long-range predictor memory 7 which are identical to the adder 33 and long-range predictor memory 34 in FIG. 4. Specifically, the long-range predictor 8 has the same configuration as that of the long-range predictor 35 of the transmitter shown in FIG. 4. It generates a residual signal from the voice source signal supplied by the adder 5 based on the pitch period and pitch gain supplied by the parameter decoder 3 and outputs the residual signal to the linear predictor 11.

The linear predictor 11 is comprised of an adder 9 and a short-range predictor memory 10 which are identical to the adder 36 and short-range predictor 37 shown in FIG. 4. Specifically, the linear predictor 11 has the same configuration as that of the short-range predictor 38 of the transmitter shown in FIG. 4. It provides a voice signal $x_n$ by synthesizing the residual signal $\alpha$ supplied by the long-range predictor 8, the linear predictive coefficients $\alpha_1, \alpha_2, \ldots, \alpha_P$ supplied by the parameter decoder 3 and synthesized voice signals $x_{n-1}, x_{n-2}, \ldots, x_{n-P}$ which have been already synthesized by itself according to the following equation.

$$x_n = \epsilon - (\alpha_1 x_{n-1} + \alpha_2 x_{n-2} + \ldots + \alpha_P x_{n-P}) \qquad \text{Equation 8}$$

As described above, the same voice signal as the voice signal $x_n$ output by the short-range predictor 38 (FIG. 4) which minimizes the difference from the voice signal x(n) input to the transmitter is synthesized at the receiver.

The voice signal synthesized at the receiver agrees with the voice signal $x_n$ synthesized at the short-range predictor 38 of the transmitter (FIG. 4) according to the AbS method as described above when the signal transmitted from the transmitter (encoded parameters) is received as it is over the channel, i.e., when the values stored in the long-range predictor memory 34 and short-range predictor memory 37 of the transmitter respectively agree with the values stored in the long-range predictor memory 7 and short-range predictor memory 10 of the receiver.

However, errors frequently occur in a signal from the transmitter on a communication channel due to various reasons such as poor quality of the channel, which can hinder the signal transmitted from the transmitter (encoded parameters) from being received by the receiver as it is.

Then, the error detecting and correcting codes are added by the channel encoder 43 (FIG. 5) at the transmitter, and errors are detected and corrected at the receiver by the channel decoder 2 using the error detecting and correcting codes.

However, in the case of an error which is too severe to correct though it can be detected, the values stored in the long-range predictor memory 7 and short-range predictor memory 10 of the receiver will not agree with the values stored in the long-range predictor memory 34 and short-range predictor memory 37 of the transmitter. In this case, the receiver may output a voice signal which is higher or lower in level (energy or amplitude) than the voice signal synthesized by the short-range predictor 38 of the transmitter (FIG. 4) according to the AbS method, and the voice having the higher level (energy or amplitude) can be harmful to the ear drum of the user.

Conventional receivers have an arrangement wherein when an uncorrectable error is detected, the values stored in the long-range predictor memory 7 and short-range predictor memory 10 are changed so that the level of the voice to be synthesized will be reduced based on the parameters which have been used for synthesizing the voice signal before (e.g., immediately before) the detection of the error.

As described above, in conventional receivers, if an error can be detected, it is possible to prevent synthesized voice having a level which can damage the ear drum of the user from being output even if the error can not be corrected.

However, undetectable errors may be generated due to causes such as a communication channel of very poor quality. Especially, since the linear predictive coefficients are highly sensitive to errors, there has been a problem in that an undetectable error can result in an output voice signal having a very high level which can be harmful to the ear drum of the user.

Accordingly it is an object of the present invention to prevent voice of a high level from being output due to an undetectable error to thereby improve the safety of a device.

SUMMARY OF THE INVENTION

According to a first aspect of the present invention, there is provided a voice suppressor including a code book 4, a multiplier 5 and a long-range predictor 8 as a means for synthesizing voice based on characteristics parameters extracted from voice, a detector 12 as a means for detecting whether the level of voice output by a linear predictor 11 exceeds a predetermined threshold or not and a suppressor 13 as a means for suppressing the level of the voice output by the linear predictor 11 based on the result of the detection performed by the detector 12.

According to a second aspect of the present invention, there is provided a voice suppressor wherein the characteristics parameters include at least linear predictive coefficients; the synthesizing means includes the code book 4, a multiplier 5 and a long-range predictor 8 as a means for generating a residual signal from the characteristics parameters, a group of registers 21 as a means for storing synthesized voice, a multiplying portion 22 as a means for multiplying the voice stored in the group of registers 21 by the linear predictive coefficients, an adder 9 and an adding portion 23 as a means for adding the output of the multiplying portion 22 and the residual signal; and a memory initializing device 14 is further provided as a means for initializing the group of registers 21.

According to a third aspect of the present invention, there is provided a voice suppressor wherein the suppressor 13 suppresses the level of the voice output by the linear predictor 11 to a value equal to or lower than a predetermined threshold.

According to a fourth aspect of the present invention, there is provided a voice suppressor wherein the characteristic parameters are extracted from voice in each of predetermined frames and wherein the suppressor 13 suppresses the level of the voice in a frame output by the linear predictor 11 to a value equal to or lower than the level of the voice in the preceding frame.

In the voice suppressor according to the first aspect of the present invention, it is determined whether the level of voice synthesized based on the characteristics parameters extracted from voice exceeds the predetermined threshold or not and the level of the synthesized voice is suppressed based on the result of the detection. It is therefore possible to prevent .voice of a high level from being output.

In the voice suppressor according to the second aspect of the present invention, the synthesized voice stored in the group of registers 21 is multiplied by the linear predictive coefficients and voice is synthesized by adding the result of the multiplication and the residual signal. It is detected whether the level of the synthesized voice exceeds the predetermined threshold or not, and the group of registers 21 is initialized based on the result of the detection. Therefore, when voice is synthesized based on the linear predictive coefficients including an error, synthesis of the next voice from being performed using this voice.

In the voice suppressor according to the third aspect of the present invention, the suppressor 13 suppresses the level of the voice output by the linear predictor 11 to a value equal to or lower than the predetermined threshold. This prevents voice having a high level which can be harmful to the ear drum of the user from being output.

In the voice suppressor according to the fourth aspect of the present invention, the characteristics parameters are extracted from voice in each of predetermined frames and the suppressor 13 suppresses the level of the voice in a frame output by the linear predictor 11 to a value equal to or lower than the level of the voice in the preceding frame. Therefore, if an error is included in the characteristics parameters of the frame of the last synthesized voice, it is possible to prevent voice having a level which can be harmful to the ear drum of the user from being output.

DETAILED DESCRIPTION OF THE PREFERRED EMBODIMENT

Figure 1:
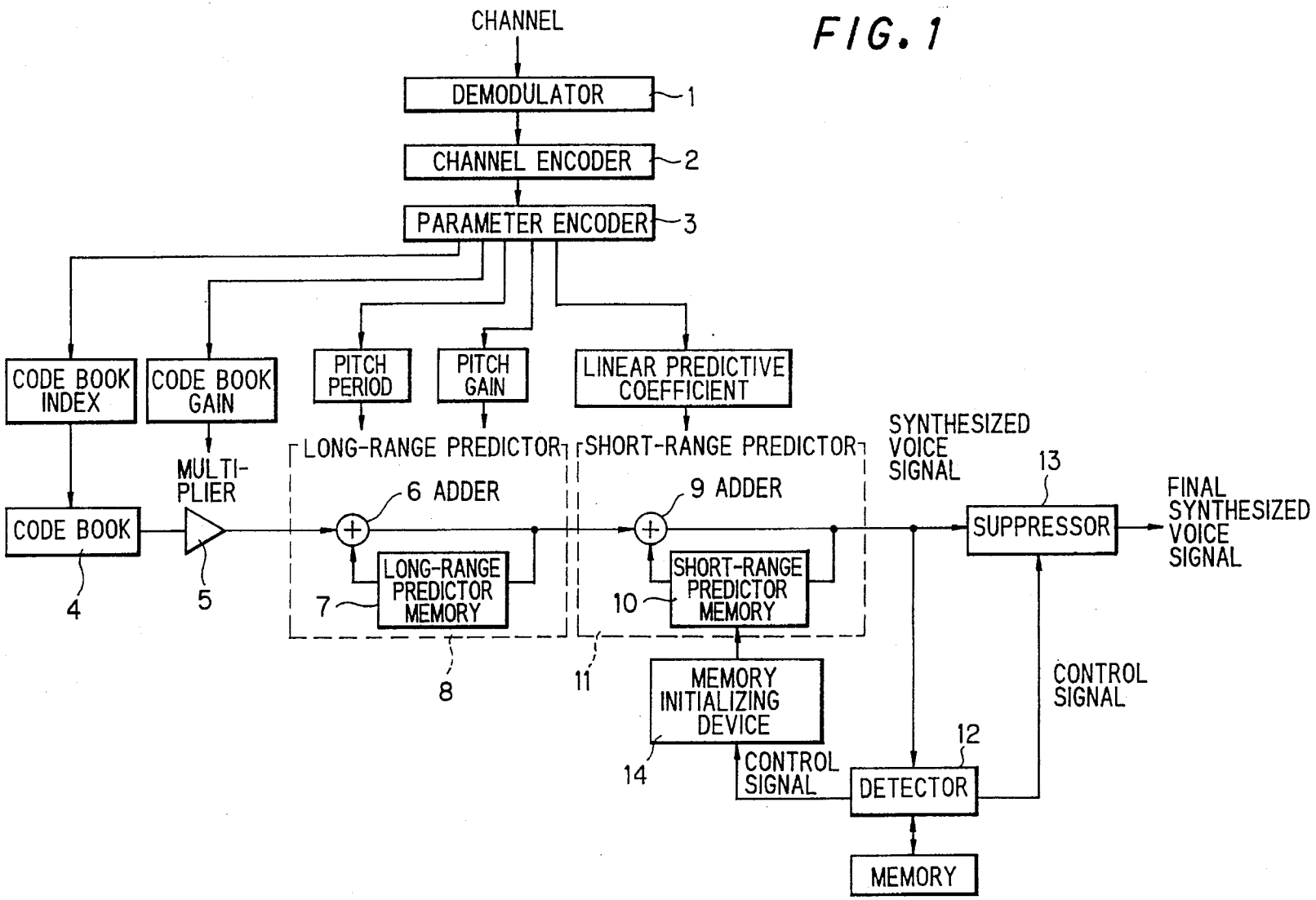
FIG. 1 is a block diagram showing a configuration of an embodiment of a receiver of a cellular telephone wherein a voice suppressor according to the present invention is used.
Figure 5:
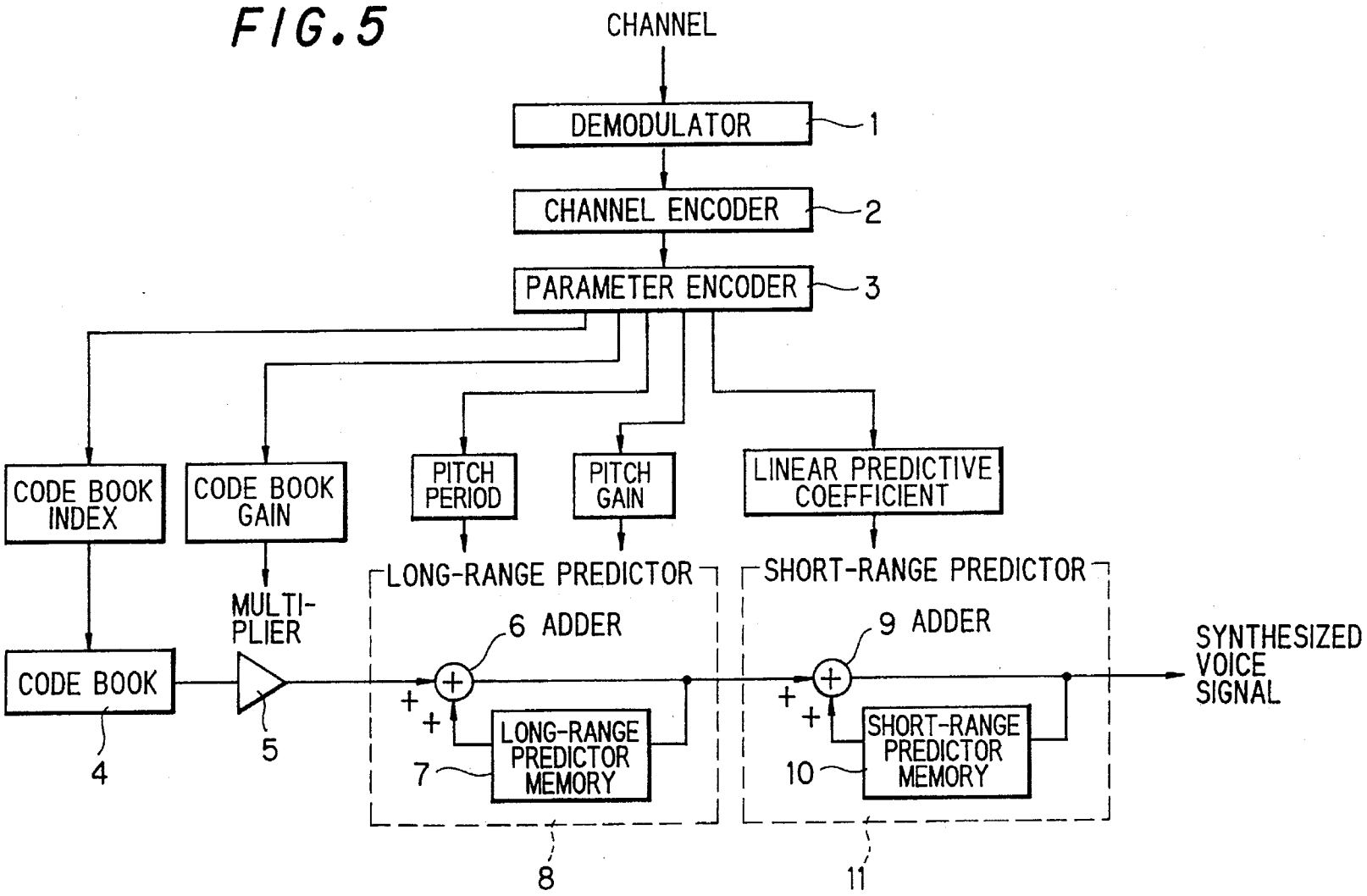
FIG. 5 is a block diagram showing a configuration of an example of a conventional receiver of a cellular telephone.

FIG. 1 is a block diagram showing a configuration of an embodiment of a receiver of a cellular telephone wherein a voice suppressor according to the present invention is used. In the figure, parts corresponding to those in FIG. 5 are designated by like reference numbers.

Figure 4:
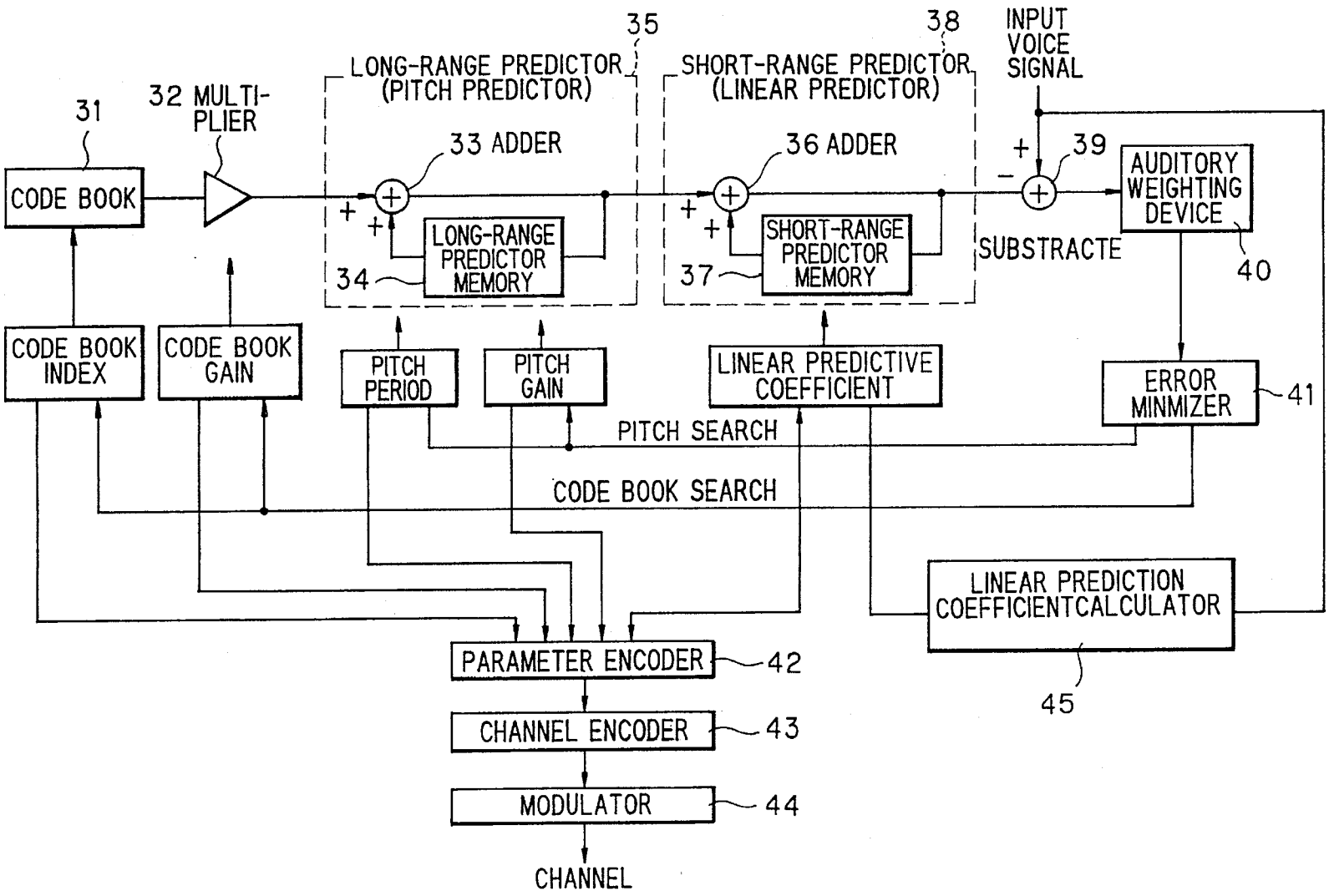
FIG. 4 is a block diagram showing a configuration of an example of a conventional transmitter of a cellular telephone.

A signal (spread spectrum signal) transmitted from, for example, the transmitter shown in FIG. 4 and received over a communication channel is processed as described above by a demodulator 1, channel decoder and parameter decoder 3 to decode encoded parameters. The decoded parameters, i.e., the code book index, code book gain and pitch period M and pitch gain $\beta$ are respectively supplied to a code book 4, a multiplier 5 and a long-range predictor 8, and the linear predictive coefficients are supplied to linear predictor 11.

The parameters are decoded frame by frame. After being decoded, the code book index, code book gain and the pitch period M and pitch gain $\beta$ are respectively supplied to the code book 4, multiplier 5 and long-range predictor 8 subframe by subframe; and the linear predictive coefficients are supplied to the linear predictor 11 frame by frame.

The voice source signal associated with the code book index supplied by the decoder 3 is read from the code book 4 and is output to the multiplier 5. The multiplier 5 amplifies (or attenuates) the voice source signal from the code book 4 by a quantity corresponding to the code book gain supplied by the decoder 3 and outputs the resultant signal to the adder 6 of the long-range predictor 8.

In the long-range predictor 8, the voice source signal from the multiplier 5 is supplied to the long-range predictor memory 7 through the adder 6 to be delayed by a period of time corresponding to the pitch period supplied by the decoder 3. The long-range predictor memory 7 further amplifies (or attenuates) the delayed signal by a quantity corresponding to the pitch gain also supplied by the decoder 3 and outputs the resultant signal to the adder 6. At the adder 6, the voice source signal from the multiplier 5 is added with the output of the long-range predictor memory 7 to thereby generate a residual signal having a period and a level (amplitude or energy) respectively corresponding to the pitch period and pitch gain supplied by the decoder 3.

This residual signal is input to the linear predictor 11 which synthesizes voice based on the residual signal and the linear predictive coefficients supplied by the decoder 3.

Figure 2:
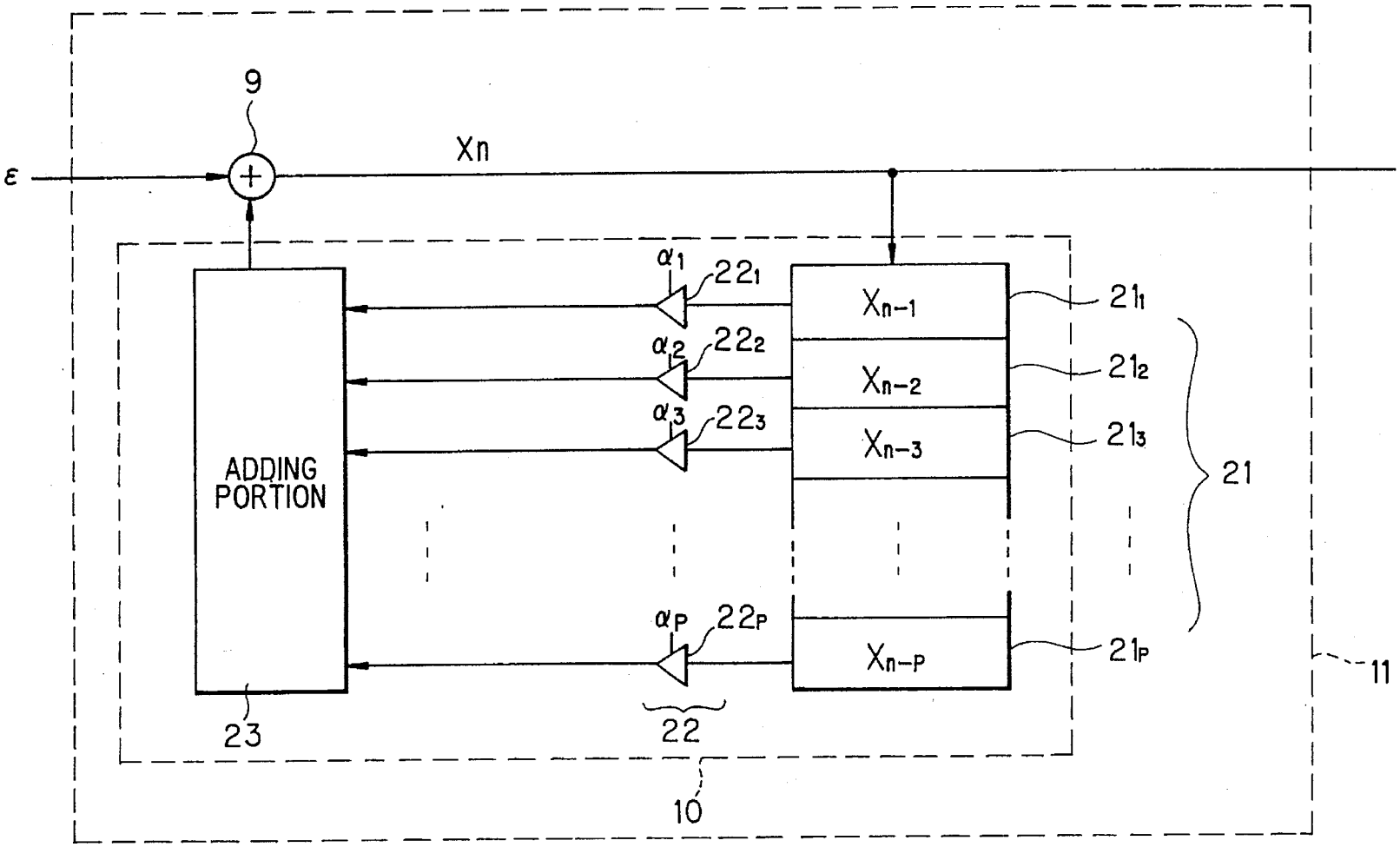
FIG. 2 is a more detailed block diagram showing a linear predictor 11 in the embodiment shown in FIG. 1.

The operation of the linear predictor 11 will now be more specifically described with reference to FIG. 2. As described above, the linear predictor 11 is comprised of the adder 9 and short-range predictor memory 10, and, as shown in FIG. 2, the short-range predictor memory 10 is comprised of the group of registers 21 consisting of registers $\mathbf{21}_1$ through $\mathbf{21}_P$ in the same number as the number of the degrees P of the linear predictive coefficients, a multiplying portion 22 consisting of multipliers $\mathbf{22}_1$ through $\mathbf{22}_P$ also in the same number as the number of the degrees P of the linear predictive coefficients and an adding portion 23.

A voice signal $x_n$ output by the adder 9 is latched in the register $\mathbf{21}_1$ as a voice signal delayed by one sample clock. A register $\mathbf{21}_p$ (p=1, 2, . . . P) is adapted to latch a voice signal for one sample clock and to thereafter output the signal to a register $\mathbf{21}_{p+1}$. Therefore, at a point in time n, a voice signal $x_{n-p}$ delayed from the time n by p sample clocks is latched in the register $\mathbf{21}_p$.

The voice signal which has been latched in the register $\mathbf{21}_P$ is discarded because there is no succeeding register.

Voice signals $x_{n-1}$ through $x_{n-P}$ latched in the registers $\mathbf{21}_1$ through $\mathbf{21}_P$ (voice signals which have already been synthesized) are read out to the multipliers $\mathbf{22}_1$ through $\mathbf{22}_P$, respectively.

The multipliers $\mathbf{22}_1$ through $\mathbf{22}_P$ are respectively supplied with the linear predictive coefficients $\alpha_1$ through $\alpha_P$ in addition to the voice signals $x_{n-1}$ through $x_{n-P}$. The voice signals $x_{n-1}$ through $x_{n-P}$ are respectively multiplied by the linear predictive coefficients $\alpha_1$ through $\alpha_P$, and the results of the multiplication are multiplied by −1 and are output to the adding portion 23. The sum of the output of the multipliers $\mathbf{22}_1$ through $\mathbf{22}_P$ $(-\alpha_1 x_{n-1}, -\alpha_2 x_{n-2}, \ldots -\alpha_P x_{n-P})$ is obtained at the adding portion 23 and the result $-(\alpha_1 x_{n-1}+\alpha_2 x_{n-2}, \ldots +\alpha_P x_{n-P})$ is output to the adder 9.

The residual signal $\epsilon$ from the long-range predictor 8 (FIG. 1) is added with the signal $-(\alpha_1 x_{n-1}+\alpha_2 x_{n-2}, \ldots +\alpha_P x_{n-P})$ and is output by the adder 9. Thus, the adder 9 provides an output $\epsilon-(\alpha_1 x_{n-1}+\alpha_2 x_{n-2}, \ldots +\alpha_P x_{n-P})$ which is the voice signal $x_n$ at the point in time n according to the Equation 1 (or Equation 8).

Returning now to FIG. 1, the voice signal output by the adder 9 is output not only to the short-range predictor memory 10 as described above but also to the detector 12 and the suppressor 13. The detector 12 detects, for example, the magnitude of the maximum or minimum value (absolute value) of the amplitude (hereinafter referred to as peak value) of the voice signal synthesized by the adder 9, i.e., the linear predictor 11, for each frame as the level of the same signal and compares this peak value to a predetermined threshold. If, for example, the voice signal output by the linear predictor 11 has been synthesized based on parameters including errors, resulting in a detected peak value exceeding the predetermined threshold (or a peak value equal to or greater than the predetermined threshold), the detector 12 supplies a control signal to the suppressor 13 and the memory initializing device 14.

The predetermined threshold is set at a value such that a high level voice signal output by the linear predictor 11 is suppressed to a level suitable to human sense of hearing based on, for example, the maximum amplitude, the maximum energy or the like as the level of voice synthesized according to parameters including no error. This value may be either fixed or variable.

The suppressor 13 normally outputs the voice signal supplied by the linear predictor 11 as it is. Further, upon reception of the control signal from the detector 12, the suppressor 13 immediately outputs the voice signal supplied by the linear predictor 11 with the level thereof suppressed to 0. In other words, upon receipt of the control signal from the detector 12, the suppressor 13 immediately stops outputting the voice signal supplied by the linear predictor 11.

When the output of the control signal from the detector 12 is stopped, the suppressor 12 resumes outputting the voice signal from the linear predictor 11.

Therefore, even if the linear predictor 11 synthesizes voice based on parameters including errors resulting in, for example, an output signal of a high level (amplitude or energy), it is possible not to give the user an uncomfortable feeling because the output of the voice signal is stopped by the suppressor 13.

As described above, the linear predictor 11 is adapted to synthesize a voice signal utilizing a voice signal which has already been synthesized by itself and stored in the group of registers 21 (FIG. 2) in addition to the residual signal supplied by the long-range predictor 8 and the linear predictive coefficients supplied by the decoder 3.

Therefore, for example, when a voice signal of a high level is synthesized based on the parameters of a frame including errors, this voice signal of a high level is stored in the group of registers 21. In this case, the linear predictor 11 performs voice synthesis using the voice signal of a high level stored in the group of registers 21 (a voice signal which has been increased in level due to parameter errors) even if parameters including no error is supplied as the parameters for the succeeding frame.

In this case, therefore, a voice signal of a high level can be output again regardless of the fact that the transmitted frame includes no error As a result, there is a possibility that the suppressor 13 stops the output of a voice signal supplied by the linear predictor 11 for a long time, leading the user to a misunderstanding that there is a problem in the apparatus.

In order to prevent this, upon reception of the control signal from the detector 12, the memory initializing device 14 resets the group of registers 21 (FIG. 2) constituting the short-range predictor memory 10 of the linear predictor 11 to, for example, 0 as an initial value.

This prevents the situation that the output of voice synthesized based on parameters including no error is stopped for a long time after the output of voice synthesized based on parameters including errors is stopped.

Figure 3:
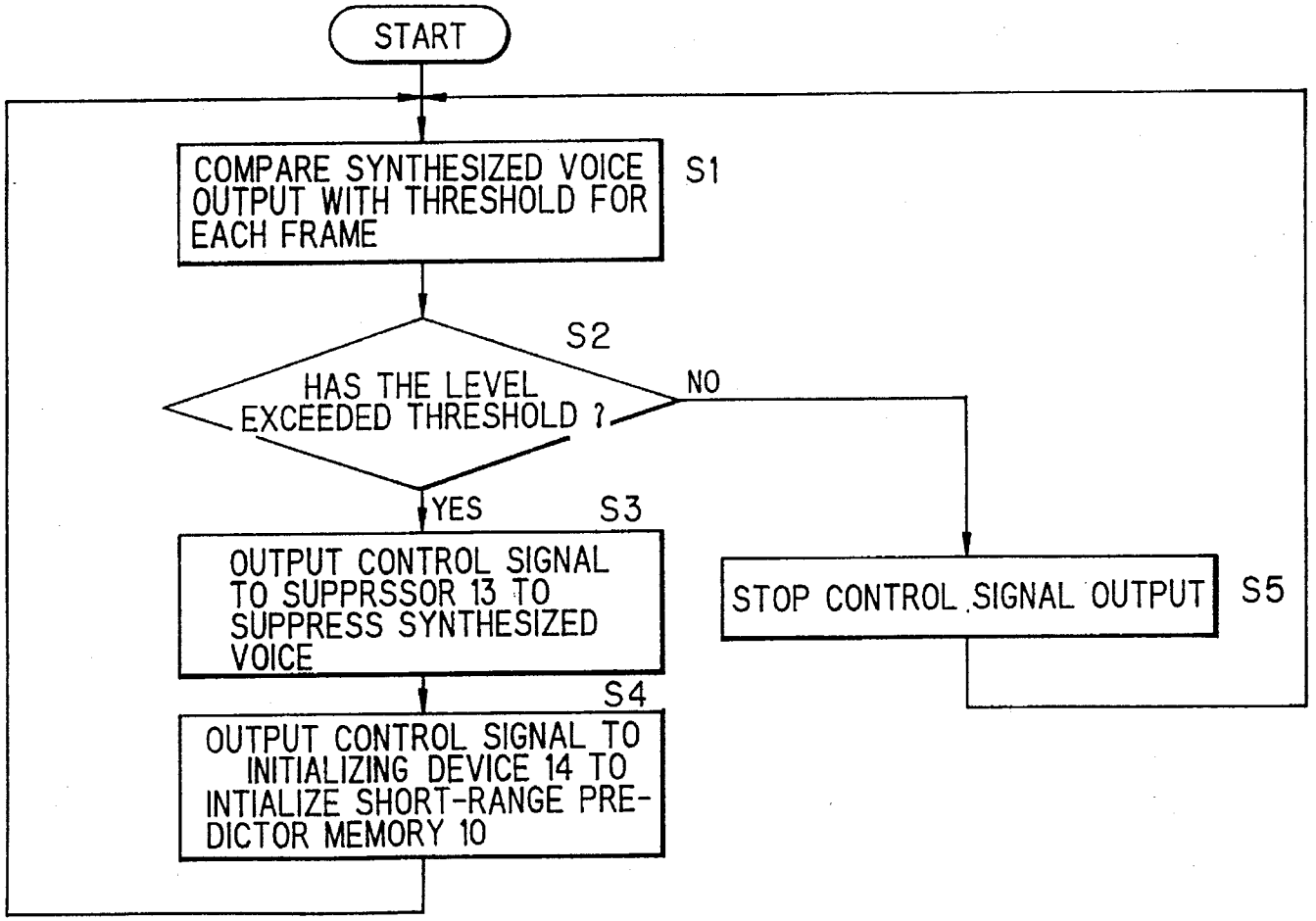
FIG. 3 is a flow chart illustrating the operation of a detector 12 in the embodiment shown in FIG. 1.

The operation of the detector 12 will now be more specifically described with reference to FIG. 3. First, the level of a voice signal output by the linear predictor 1 is compared to a predetermined threshold frame by frame at step S1, and it is determined at step S2 whether the level of the voice signal is higher than the predetermined threshold or not.

If it is determined at step S2 that the level of the voice signal output by the linear predictor 11 is higher than the predetermined threshold, the process proceeds to step S3 at which a control signal is output to the suppressor 13.

The suppressor 13 then stops the output of the voice signal supplied by the linear predictor 11 as described above.

Then, a control signal is output to the initializing device 14 at step S4 and the process returns to step S1.

The initializing device 14 thus resets the values stored in the group of registers 21 (FIG. 2) of the linear predictor 11 to 0.

On the other hand, if it is determined at step S2 that the level of the voice signal output by the linear predictor 11 is not higher than the predetermined threshold, the process proceeds to step S5 at which if the control signals are being output to the suppressor 13 and the initializing device 14, the output of the control signals is stopped and the process returns to step S1.

Although a voice suppressor according to the present invention has been described with respect to an application of the same to a cellular telephone, the present invention may be also applied to control over the output of a voice synthesizer which performs voice synthesis based on the characteristics of voice.

The initializing device 14 is adapted to reset the values stored in the group of registers 21 to 0 as initial values according to the present embodiment, but the present invention is not limited thereto. Specifically, a memory may be incorporated in the initializing device 14 to store, for example, the values stored in the group of registers 21 frame by frame so that, when a control signal is output from the detector 12, the values in the incorporated memory for the frame immediately preceding the timing of the reception of the control signal are set in the group of registers 21.

Further, although the detector 12 is adapted to detect the peak value of a voice signal output by the linear predictor 11 frame by frame according to the present embodiment, it is possible to adapt it, for example, to detect the energy of each frame of the voice signal or characteristic values of the voice signal corresponding thereto.

In addition, the detector 12 may be adapted to detect the peak value and energy of each frame of a voice signal and to compare them to respective predetermined thresholds.

When the receiver shown in FIG. 1 (or, for example, a cellular telephone having the receiver in FIG. 1 and the transmitter in FIG. 4) is implemented using a DSP, to store data in the group of registers 21 on a fixed-point basis using a predetermined bit length such as 16 bits, the detector 12 may be adapted to detect an overflow of the group of registers 21 (register $\mathbf{21}_1$) and to output a control signal based on the result of the detection.

Further, although the suppressor 13 is adapted to stop the output of a voice signal supplied by the linear predictor 11 according to the present embodiment, the present invention is not limited thereto.

Specifically, the suppressor 13 may be adapted, for example, to output a voice signal supplied by the linear predictor 11 after suppressing the level (amplitude or energy) of the same signal to a value equal to or lower than a predetermined level.

Alternatively, the suppressor 13 may be adapted to output a voice signal supplied by the linear predictor 11 after suppressing the level (amplitude or energy) of the same signal to a value equal to or lower than the predetermined threshold used in the detector 12.

Furthermore, the suppressor 13 may be adapted, for example, to output a voice signal supplied by the linear predictor 11 after suppressing the level (amplitude or energy) of the same signal to a value equal to or lower than the level of the voice signal in the frame preceding the voice signal. In this case, it is necessary to provide a memory 15 for storing the level of the voice signals detected by the detector 12 frame by frame as shown in FIG. 1 to allow the detector 12 to output the level of the voice signal in the preceding frame stored in the memory 15 along with the control signal.

However, it will be less uncomfortable to the ears of the user to suppress a voice signal to substantially 0 level as in the present embodiment than suppressing the voice signal to a certain level.

In addition, although an application of the present invention to a receiver which decodes a voice signal encoded according to the CELP method has been described in the present embodiment, the present invention is not limited thereto and may be applied to decoding of voice signals encoded according to other encoding methods as long as linear predictive synthesis is employed.

Although linear predictive coefficients of voice are transmitted as characteristic parameters of the voice in the description of the present embodiment, the present invention may be applied to cases wherein other kinds of parameters such as cepstrum coefficients are transmitted. In this case, however, it is necessary to provide a block for converting the transmitted parameters into linear predictive coefficients.

While a voice signal synthesized by the linear predictor 11 is directly supplied to the suppressor 13 in the present embodiment, for example, an adaptive post-process filter may be provided between the linear predictor 11 and the suppressor 13 to supply the voice signal synthesized by the linear predictor 11 to the suppressor 13 after processing the signal by the adaptive post-process filter.

Since the processing time required for performing the above-described suppression of synthesized voice is sufficiently shorter than the time required for the voice to be encoded by the transmitter and decoded and synthesized by the receiver (approximately 100 ms), the process will not adversely affect the operation of the apparatus.

With a voice suppressor according to the first aspect of the present invention, it is detected whether the level of voice synthesized based on characteristics parameters extracted from voice exceeds a predetermined threshold or not, and the level of the synthesized voice is suppressed based on the result of the detection. This makes it possible to prevent voice of a high level from being output.

With a voice suppressor according to the second aspect of the present invention, synthesized voice stored in a storing means is multiplied by linear predictive coefficients, and voice is synthesized by adding a residual signal to the result of the multiplication; it is detected whether the level of the synthesized voice exceeds a predetermined value; and the storing means is initialized based on the result of the detection. Therefore, when voice is synthesized based on linear predictive coefficients including errors, it is possible to prevent the next voice from being synthesized using this voice with a voice suppressor according to the third aspect of the present invention, the level of voice output by a synthesizing means is suppressed by a suppressing means to a value equal to or lower than a predetermined threshold. This makes it possible to prevent the output of voice having a high level which can be harmful to the drum of the user.

With a voice suppressor according to the fourth aspect of the present invention, characteristics parameters are extracted from voice in each of predetermined frames, and a suppressing means suppresses the level of the voice in a frame output by a synthesizing means to a value equal to or lower than the level of the voice in the preceding frame. Therefore, when an error is included in the characteristics parameters of the voice frame most recently synthesized, it is possible to prevent the output of voice having a high level which can be harmful to the drum of the user.

Various details of the invention may be changed without departing from its spirit nor its scope. Furthermore, the foregoing description of the embodiment according to the present invention is provided for the purpose of illustration only, and not for the purpose of limiting the invention as defined by the appended claims and their equivalents.

What is claimed is:

1. A voice suppressor comprising:

means for synthesizing a voice output based on characteristic parameters extracted from an input voice, the characteristic parameters including linear predictive coefficients, the synthesizing means outputting the voice output;

means for detecting whether a level of the voice output exceeds a predetermined threshold; and means for suppressing the level of said voice output based on a detection of the level of the voice output exceeding the predetermined threshold by said detecting means.

2. A voice suppressor comprising:

means for synthesizing a voice output based on characteristic parameters extracted from an input voice, the characteristic parameters including linear predictive coefficients, the synthesizing means outputting the voice output;

means for detecting whether a level of the voice output exceeds a predetermined threshold; and means for suppressing the level of said voice output when the level of the voice output exceeds the predetermined threshold;

said synthesizing means also including means for generating a residual signal from said characteristic parameters, means for storing a previously synthesized voice, means for multiplying the previously synthesized voice stored in said storing means by said linear predictive coefficients, and means for adding an output of said multiplying means and said residual signal; and means for initializing said storing means based on said detecting means detecting that the level of the voice output exceeds the predetermined threshold.

3. The voice suppressor according to claim 1, wherein; said suppressing means suppresses the level of said voice output to a value equal to or lower than the predetermined threshold.

4. The voice suppressor according to claim 1, wherein:

said characteristic parameters are extracted from said voice in each of predetermined frames; and said suppressing means suppresses the level of said voice output in a frame to a level of said output voice in a preceding frame.

5. The voice suppressor according to claim 1, wherein:

the predetermined threshold is a value of energy.

6. The voice suppressor according to claim 1, wherein:

the predetermined threshold is a value of the maximum amplitude.

* * * * *